United States Patent [19]

Kato et al.

[11] Patent Number: 4,926,827

[45] Date of Patent: May 22, 1990

[54] OUTPUT CORRECTION METHOD FOR EXHAUST GAS INGREDIENT-CONCENTRATION SENSORS

[75] Inventors: Akira Kato; Toru Yano, both of Wako, Japan

[73] Assignee: Honda Giken Kogyo K.K., Tokyo, Japan

[21] Appl. No.: 338,987

[22] Filed: Apr. 14, 1989

[30] Foreign Application Priority Data

Jun. 30, 1988 [JP] Japan ..... 63-162856

[51] Int. Cl.[5] ..... F02D 41/14

[52] U.S. Cl. ..... 123/489; 123/488

[58] Field of Search ..... 123/440, 488, 489

[56] References Cited

U.S. PATENT DOCUMENTS 4,723,521 2/1988 Mieno et al. ..... 123/489
4,729,219 3/1988 Kayanuma et al. ..... 123/489
4,788,958 12/1988 Nakajima et al. ..... 123/489

FOREIGN PATENT DOCUMENTS 201346 9/1987 Japan .

*Primary Examiner*—Tony M. Argenbright
*Attorney, Agent, or Firm*—Arthur L. Lessler

[57] ABSTRACT

An output correction method for an exhaust gas ingredient-concentration sensor for internal combustion engines. The sensor has two sensor elements having output characteristics different from each other. The sensor elements each produce an output proportional to the concentration of an ingredient in exhaust gases emitted from the engine. The sensor controls the air-fuel ratio of a mixture supplied to the engine to a desired air-fuel ratio by the use of an output from at least one of the sensor elements. First, it is determined whether or not the difference between the desired air-fuel ratio and an actual air-fuel ratio represented by the output of at least one of the sensor elements is smaller than a predetermined value. Then, an output value of one of the sensor elements is corrrected based on an output value of the other of the sensor elements when it is determined that the difference is smaller than the predetermined value.

11 Claims, 9 Drawing Sheets

| FIG. 1A |
| --- |
| FIG. 1B |

| FIG. 3A |
| --- |
| FIG. 3B |

OUTPUT CORRECTION METHOD FOR EXHAUST GAS INGREDIENT-CONCENTRATION SENSORS

BACKGROUND OF THE INVENTION

This invention relates to an output correction method for exhaust gas ingredient-concentration sensors adapted for use in internal combustion engines, and more particularly to a method of this kind, which utilizes a sensor formed of two oxygen concentration sensor elements having proportional output characteristics different from each other and corrects the output value of one sensor element based upon the output value of the other sensor element.

Electronic fuel supply control for internal combustion engines generally includes air-fuel ratio feedback control wherein the concentration of an ingredient contained in exhaust gases emitted from the engine is detected, and the air-fuel ratio of a mixture actually supplied to the engine (hereinafter called "the actual air-fuel ratio") is controlled to a desired air-fuel ratio in a feedback manner responsive to the detected concentration value, in order to improve emission characteristics, fuel consumption, and so on. Conventional air-fuel ratio feedback control methods include methods using a proportional output type sensor as the exhaust gas ingredient-concentration sensor, which has such an output characteristic as to produce an output proportional to the concentration of an ingredient in the exhaust gases.

However, such proportional output type sensor is required to have an output accurately corresponding to the ingredient concentration for properly controlling the air-fuel ratio. However, after a long-term use, the sensor is apt to deteriorate mainly due to clogging of a gas-introducing slit thereof with oxides etc. contained in the exhaust gases, failing to maintain a desired output characteristic. However, the deterioration of the sensor cannot be easily detected by the use of a single sensor element.

To solve the above problem, a method of correcting the output value of an exhaust gas ingredient-concentration sensor has been proposed, e.g., by Japanese Provisional Patent Publication (Kokai) No. 62-201346, which uses a sensor formed of two oxygen concentration sensor elements having different output characteristics from each other, and corrects the output value of one sensor element based upon an output value of the other sensor element when a predetermined operating condition of the engine is satisfied, i.e., when the engine is in a stable operating state.

However, the proposed method has the disadvantage that correction of the sensor output characteristic cannot be accurately effected when the engine is operating in particular operating regions. Specifically, in general, when the engine is in a stable operating state, the actual air-fuel ratio can be controlled to a desired air-fuel ratio or its approximal ratio. However, there can be cases where the engine operation is stable even when the actual air-fuel ratio is considerably different from the desired air-fuel ratio. For example, when there is a large amount of fuel adhering to the inner wall of the intake pipe, the adhering fuel is entrained into the engine cylinders together with fuel normally injected into the intake pipe to thereby cause the actual air-fuel ratio to be excessively rich. Also, when the adhering fuel amount is very small, part of the mixture normally injected into the injection pipe adheres to the inner wall of the intake pipe to thereby cause the actual air-fuel ratio to be excessively lean. This tendency is remarkable particularly when the engine is restarted at a high temperature shortly after it is stopped, or when the engine is brought into a constant-speed operation after acceleration or deceleration.

However, according to the proposed method, the output correction is carried out by comparing the output value of the one sensor element with the output value of the other sensor element when the actual air-fuel ratio stays at almost a constant value, that is, when the engine is in a stable operating state. Consequently, even when there is a large difference between the actual and desired air-fuel ratios during stable engine operation, as mentioned above, it is erroneously judged that the engine is in the stable operation and accordingly the output correction is effected. On such an occasion, however, the actual air-fuel ratio varies with variation in the amount of fuel actually supplied to the engine due to increase and decrease in the amount of adhering fuel to the intake pipe, etc. thereby making it impossible to carry out exact output correction of the sensor. As a result, the air-fuel ratio is erroneously controlled by improperly corrected sensor output, which can lead to clogging of the ignition plugs, excessive increase of CO in the exhaust gases, etc. when the air-fuel ratio is controlled toward the rich side, or can lead to degradation in the driveability of the engine, etc. when the air-fuel ratio is controlled toward the lean side.

Further, according to the proposed method, the feedback control of the air-fuel ratio is interrupted while the output correction is being carried out, in order to maintain the air-fuel ratio at a constant value. Consequently, the actual air-fuel ratio is not controlled toward the desired air-fuel ratio during the sensor output correction, so that the above-mentioned state in which the difference between the actual air-fuel ratio and the desired air-fuel ratio is large continues over a long period of time, thereby leading to degradation in the emission characteristics, increased fuel consumption, etc.

SUMMARY OF THE INVENTION

It is the object of the invention to provide an output correction method for exhaust gas ingredient-concentration sensors, which is capable of performing accurate output correction as well as improving the responsiveness of air-fuel ratio feedback control.

To attain the above object, the present invention provides an output correction method for an exhaust gas ingredient-concentration sensor adapted for use in an internal combustione engine, the sensor having first and second sensor elements having output characteristics different from each other, the first and second sensor elements each producing an output proportional to the concentration of an ingredient in exhaust gases emitted from the engine, wherein the sensor controls the air-fuel ratio of a mixture supplied to the engine to a desired air-fuel ratio by the use of an output from at least one of the first and second sensor elements.

The method according to the present invention is characterized by the improvement comprising the steps of:

(1) determining whether or not a difference between the desired air-fuel ratio and an actual air-fuel ratio represented by the output of at least one of the first and second sensor elements is smaller than a predetermined value, and (2) correcting an output value of one of the first and second sensor elements based on an output value of the other of the first and second sensor elements when it is determined that the difference is smaller than the predetermined value.

The above and other objects, features, and advantages of the invention will be more apparent from the ensuing detailed description taken in conjunction with the accompanying drawings.

DETAILED DESCRIPTION

The invention will now be described in detail with reference to the drawings showing an embodiment thereof.

Figures 1, 1A:
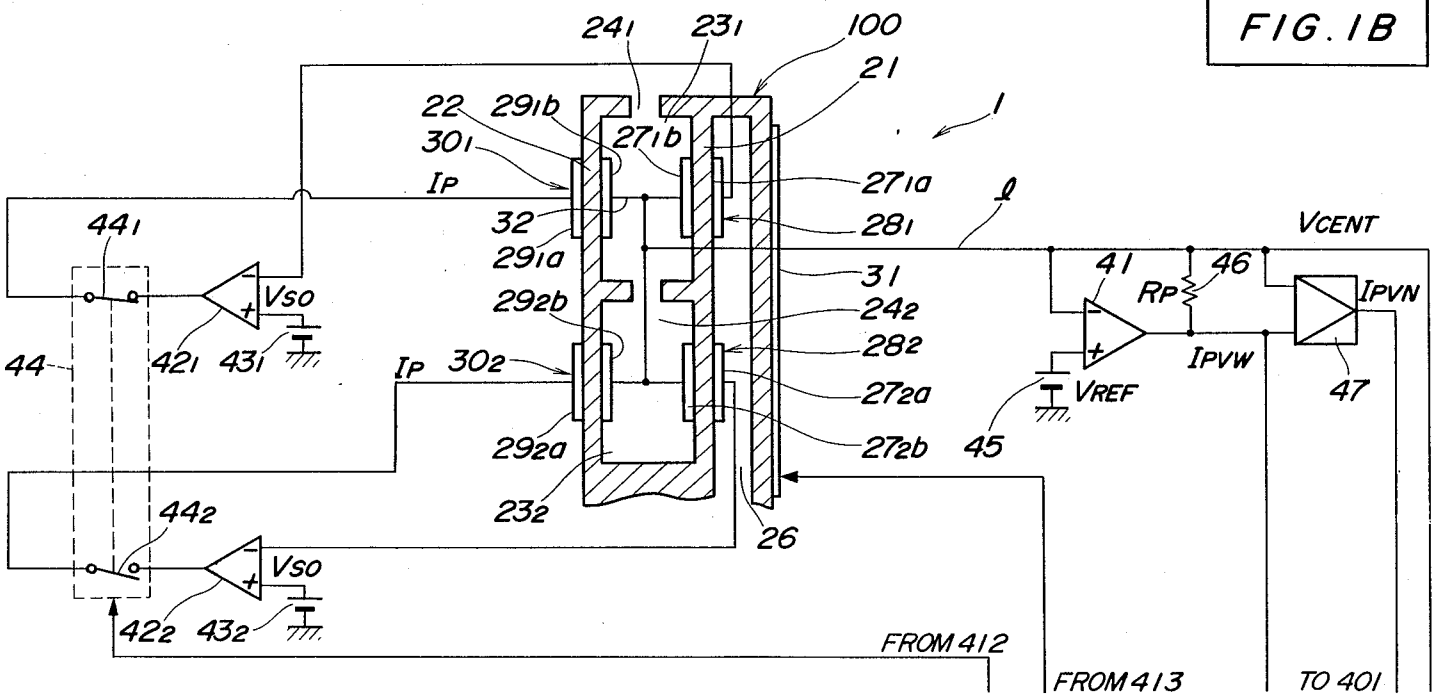
FIG. 1 is a schematic diagram of the overall arrangement of a fuel supply control system for an internal combustion engine equipped with an exhaust gas ingredient concentration ($O_2$) sensor to which the method of the invention is applied.
Figure 1B:
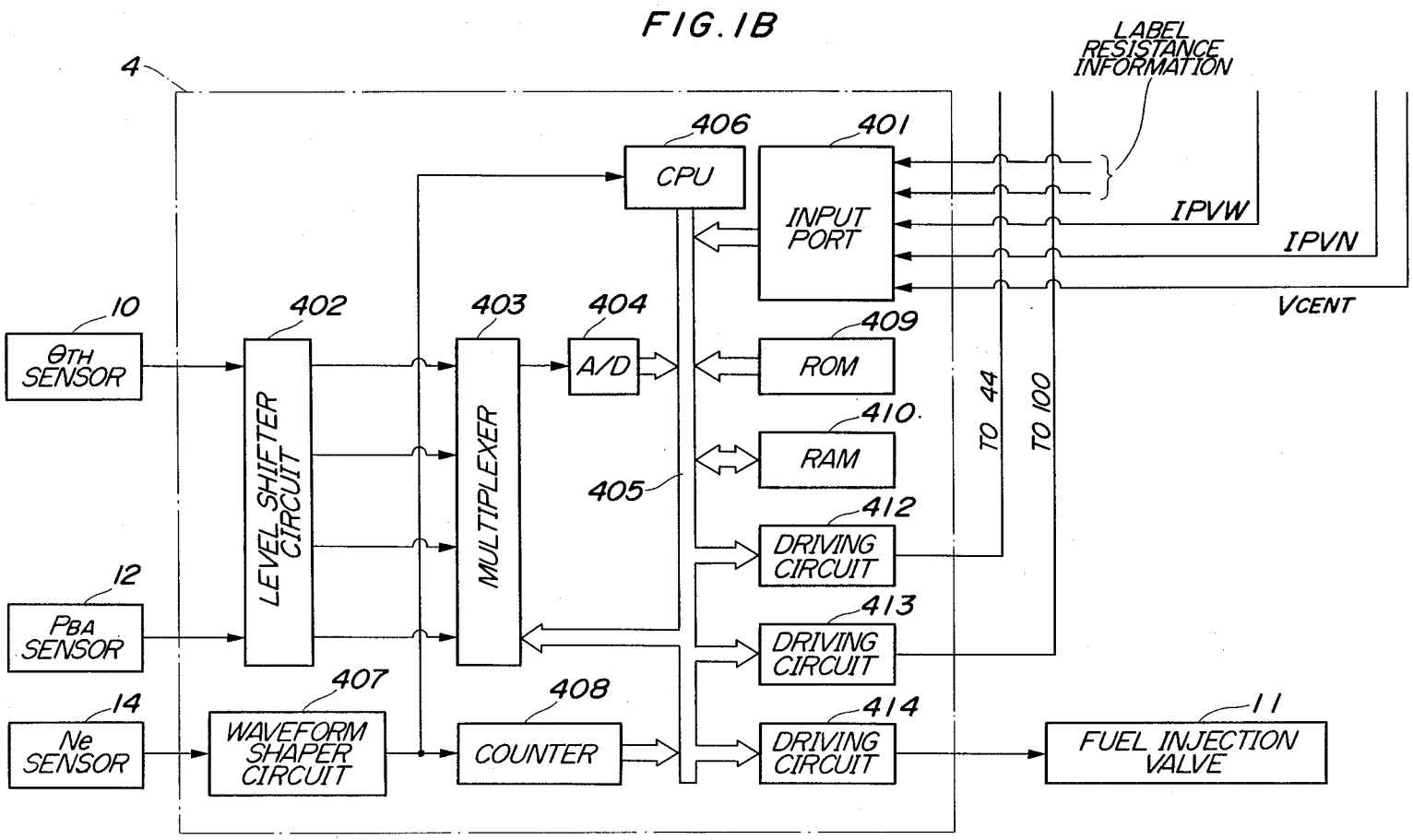

Referring first to FIG. 1, there is illustrated the whole arrangement of a fuel supply control system for an internal combustion engine including an exhaust gas ingredient-concentration sensor to which the method according to the invention is applied.

In the figure, reference numeral 100 designates a body (sensor element section) of the oxygen concentration sensor (hereinafter called "the $O_2$ sensor") 1 as an exhaust gas ingredient-concentration sensor. The sensor body 100 is arranged within an exhaust system of an engine, not shown, in which a three-way catalyst is arranged for purifying ingredients HC, CO, and NOx contained in the exhaust gases emitted from the engine.

Figure 2:
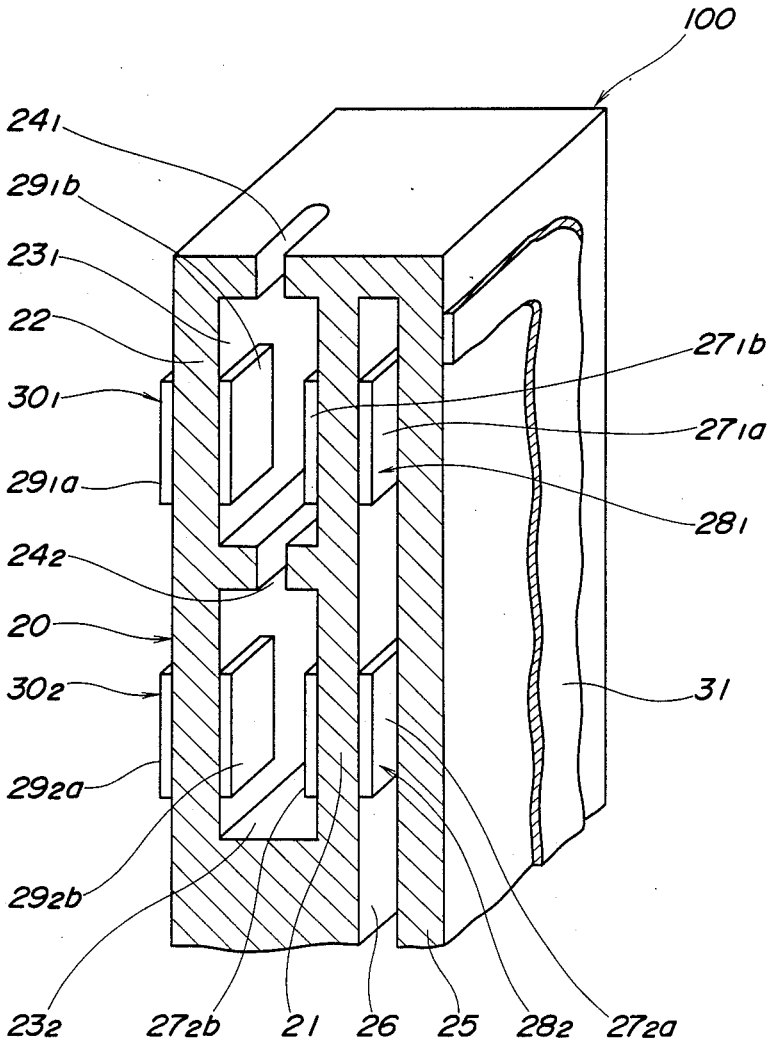
FIG. 2 is a perspective sectional view of the sensor in FIG. 1.

As shown in detail in FIG. 2, the sensor body 100 is in the form of a rectangular parallelepiped, and comprises a basic body 20 formed of a solid electrolytic material having oxygen ion-conductivity (e.g. zirconium dioxide ($ZrO_2$)).

The sensor body 100 shown in the figures is a type which has two oxygen concentration sensor elements longitudinally arranged, each having a cell element and an oxygen pumping element. The basic body 20 of the sensor body 100 has first and second walls 21, 22 extending parallel with each other, between which first and second gas diffusion chambers $23_1$, $23_2$ serving as gas diffusion-limiting zones are defined.

The first gas diffusion chamber $23_1$ is communicated with an exhaust pipe, not shown, of the engine through a first slit $24_1$ as first gas-diffusion restricting means which is disposed such that exhaust gases in the exhaust pipe can be guided into the first gas diffusion chamber $23_1$ through the slit $24_1$. The exhaust gases within the first gas diffusion chamber $23_1$ is introduced into the second gas diffusion chamber $23_2$ through a second slit $24_2$ as second gas-diffusion restricting means communicating between the two chambers $23_1$ and $23_2$. An air reference chamber 26 to be supplied with air or reference gas is defined between the first wall 21 and an outer wall 25 disposed adjacent the first wall 21 and extending parallel therewith.

In order to detect oxygen concentration within the first gas diffusion chamber $23_1$, a couple of electrodes $27_1$a, $27_1$b formed of platinum (Pt) are mounted on opposite side surfaces of the first wall 21, which cooperate with the first wall 21 to form a cell element (sensing cell) $28_1$ for the first oxygen concentration sensor element, while another couple of electrodes $29_1$a, $29_1$b are similarly mounted on opposite side surfaces of the second wall 22, which cooperate with the second wall 22 to form an oxygen-pumping element (pumping cell) $30_1$ for the first oxygen concentration sensor element.

On the other hand, in order to detect oxygen concentration within the second gas diffusion chamber $23_2$, a cell element $28_2$ for the second oxygen concentration sensor element having a couple of electrodes $27_2$a, $27_2$b, and an oxygen-pumping element $30_2$ for the second oxygen concentration sensor element having a couple of electrodes $29_2$a, $29_2$b are respectively mounted on the first and second walls 21, 22, similarly to the cell element $28_1$ and the oxygen-pumping element $30_1$.

A heater (heating element) 31 is provided on an outer side surface of the outer wall 25, for heating the cell elements $28_1$, $28_2$ and the oxygen-pumping elements $30_1$, $30_2$ to activate them.

As shown in FIG. 2, the electrodes $27_1$b and $29_1$b for the first oxygen concentration sensor element, which are located on the first gas diffusion chamber $23_1$ side, are connected with each other (in the embodiment of FIG. 1, they are connected by a suitable electrically conductive member 32), and are connected to an inverting input terminal of an operational amplifier 41 through a line 1.

On the other hand, the other electrode $27_1$a of the cell element $28_1$ for the first oxygen concentration sensor element is connected to an inverting input terminal of a differential amplifier circuit $42_1$ for the first oxygen concentration sensor element. The differential amplifier circuit $42_1$ forms a voltage-applying circuit together with a reference voltage source $43_1$ connected to an non-inverting input terminal thereof for applying to the oxygen-pumping element $30_1$ a voltage corresponding to the difference between a voltage (cell element voltage) developed between the electrodes $27_1$a and $27_1$b of the cell element $28_1$ (in the FIG. 1 embodiment, the sum of a voltage on the line 1 and the cell element voltage) and a reference voltage Vso from the reference voltage source $43_1$.

In the present embodiment, the reference voltage Vso of the reference voltage source $43_1$ is normally set to a value of the sum of the cell element voltage developed across the cell element $28_1$ when the actual air-fuel ratio of a mixture supplied to the engine is equal to a stoichiometric mixture ratio, e.g. 0.45 volts and a predetermined reference voltage, hereinafter referred to, applied to a non-inverting input terminal of the operational amplifier 41. However, the reference voltage Vso can be changed temporarily to a value, e.g., 3.05 V, higher by a predetermined value than the above normal value, when the output of the $O_2$ sensor has its value corrected for deterioration of the $O_2$ sensor 1.

The differential amplifier circuit $42_1$ has an output end thereof connected to the electrode $29_1$a of the oxygen-pumping element $30_1$ remote from the first gas diffusion chamber $23_1$ by way of a switch $44_1$ of a switching circuit 44. The switching circuit 44 is controlled to close or open in dependence on activation and non-activation of the sensor body 100 as well as on operating conditions of the engine. More specifically, when the sensor body 100 is inactivated, both of the switches $44_1$ and $44_2$ are opened, and on the other hand, when it is activated, one of the switches is closed in response to operating conditions of the engine.

The non-inverting input terminal of the operational amplifier circuit 41 is connected to a reference voltage source 45 to be supplied with the predetermined reference voltage therefrom. A current detecting resistance 46 for detecting pumping current Ip is connected between an output terminal of the operational amplifier circuit 41 and the line 1 or an inverting input terminal of the operational amplifier circuit 41. That is, the resistance 46 also serves as the negative feedback resistance of the operational amplifier circuit 41.

In the operational amplifier 41 connected as above, provided that there is no offset in the output of the circuit 41, when the actual air-fuel ratio is equal to the stoichiometric ratio, no pumping current Ip flows in the line 1 and is applied to the inverting input terminal of the circuit 41 according to the input level setting for the differential amplifier $42_1$, and then the output voltage is equal to the reference potential at the non-inverting input terminal and an electric potential at the inverting input terminal is also equal to the reference potential. On the other hand, when the actual air-fuel ratio is not equal to the stoichiometric ratio, pumping current is supplied to the inverting input terminal, an output voltage is generated at the output of the circuit 41, which corresponds to the amplification degree or factor (even if it is 1) determined by the value of the resistance 46. Although the output voltage varies in response to the magnitude of the pumping current Ip, the potential at the inverting input terminal is maintained at a constant value substantially equal to the reference potential at the non-inverting input terminal due to the action of the operational amplifier 41.

More specifically, in the above described construction, when no pumping current Ip flows in the line 1, i.e. Ip is zero, the output voltage $I_{PVW}$ of the operational amplifier 41 (i.e. the voltage at one end of the resistance 46) is made equal to the reference voltage $V_{REF}$ from the reference voltage source 45, and at the same time a voltage $V_{CENT}$ applied to the inverting input terminal (i.e. the voltage on the line 1 and at the other end of the resistance 46) is made equal to the reference voltage $V_{REF}$.

As described above, the voltage $V_{CENT}$ on the line 1 and accordingly at the other end of the resistance 46 is maintained substantially at the voltage $V_{REF}$, irrespective of whether the pumping current Ip assumes zero or varies. On the other hand, the voltage at the one end of the resistance 46 connected to the output of the operational amplifier circuit 41 is varied in response to the direction of the pumping current Ip (the positive direction or the negative direction) and the amount of the current Ip. Therefore, the voltage $V_{CENT}$ is a reference value (reference voltage) for detecting current flowing through the oxygen-pumping element and calculating the air-fuel ratio based on the detected current value.

In this sense, the potential on the line 1 is not the earth potential, but the whole system including the line 1 and the current detecting resistance 46 is raised in potential from the ground level by the reference voltage $V_{REF}$. Consequently, when the pumping current Ip is determined from a potential difference between the opposite ends of the current detecting resistance 46, that is, from the respective votages $V_{CENT}$ and $I_{PVW}$, as hereinafter described, the reference value $V_{CENT}$ as well as the other end voltage $I_{PVW}$ are always positive voltages, irrespective of whether the pumping current Ip flows in the positive direction or in the negative direction in response to the air-fuel ratio, thereby facilitating the calculation of the air-fuel ratio.

Further, the raising-up of the reference voltage of the pumping current detecting system to the constant reference voltage as above is advantageous for avoiding erroneous detection of the current due to noise, especially high level noise such as ignition pulse noise of the engine.

The volta $V_{REF}$ of the reference voltage source 45 of the operational amplifier circuit 41 is set to a predetermined voltage (e.g. 2.5 volts) also for ensuring the above described advantage.

The second oxygen concentration sensor element of the sensor body 100 has a similar construction to the first oxygen concentration sensor element. That is, in the voltage applying circuit and the switching circuit 44, there are respectively provided a differential amplifier circuit $4_{22}$, a reference voltage source $43_2$, and the aforementioned switch $44_2$. The switch $44_2$ is connected to the outer side electrode $29_2$a of the oxygen-pumping element $30_2$, and the respective inner side electrodes $27_2$b and $29_2$b of the cell element $28_2$ and the oxygen-pumping element $30_2$ are both connected to the line 1, so that, during the use of the second oxygen concentration sensor element, the pumping current Ip flowing through the oxygen-pumping element $30_2$ flows in the line 1.

The output voltage $I_{PVW}$ of the operational amplifier circuit 41 and the voltage $V_{CENT}$ on the line 1, at the opposite ends of the current detecting resistance 46, are supplied to an input port 401 of an electronic control unit (hereinafter called "the ECU") 4 and are at the same time supplied to respective inputs of a differential amplifier circuit 47.

The differential amplifier circuit 47 amplifies the difference between the voltage $V_{CENT}$ and the output voltage $I_{PVW}$ of the operational amplifier circuit 41, and thus serves to improve the accuracy of a signal indicative of a voltage detected from pumping current Ip which assumes 0 or a value close thereto, i.e. where the actual air-fuel ratio is within a predetermined range about the stoichiometric air-fuel ratio of the mixture. In the differential amplifier circuit 47, the $I_{PVW}$ signal is amplified by a predetermined magnification $\alpha$, e.g. 5 times, to be produced as a voltage $I_{PVN}$.

The output voltage $I_{PVN}$ of the differential amplifier circuit 47 is obtained by the following equation, and is also supplied to the input port 401:

$$I_{PVN} = -5(I_{PVW} - V_{CENT}) + V_{CENT} \quad (1)$$

Therefore, three voltage signals, i.e. $V_{CENT}$ as the reference voltage, $I_{PVW}$, and $I_{PVN}$ are supplied to the input port 401 for calculating the air-fuel ratio based on the pumping current Ip. Although the pumping current can be detected by using only the voltages $V_{CENT}$ and $I_{PVW}$ (a first manner of calculating the pumping current Ip), it can be more accurately detected by additionaly using the voltage $I_{PVN}$ (a second manner of calculating the pumping current Ip) when the actual air-fuel ratio is in the vicinity of the stoichiometric air-fuel ratio of the mixture in which the pumping current Ip assumes small values.

Figure 4:
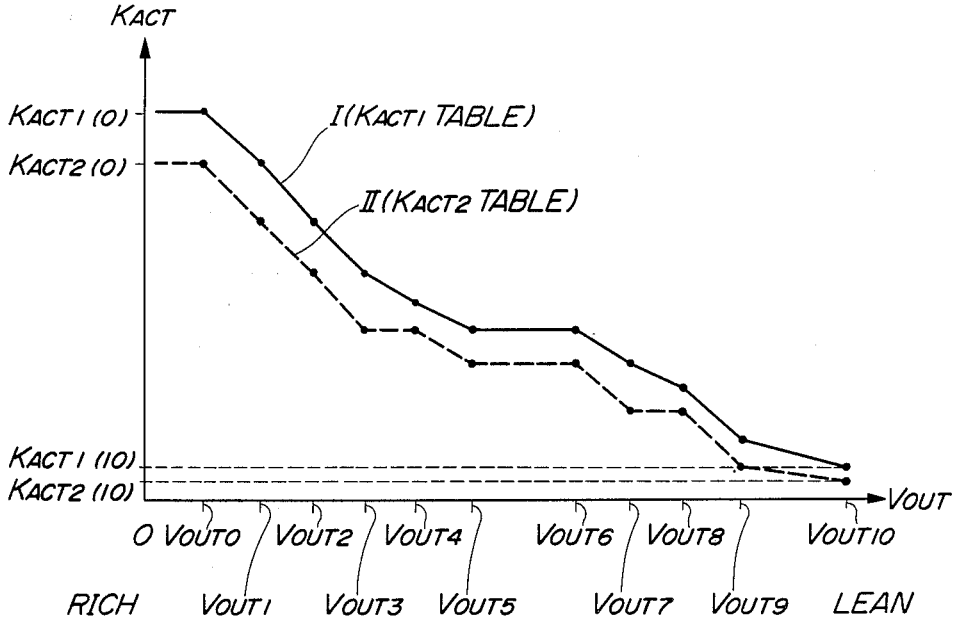
FIG. 4 is a graph showing a table of an actual air-fuel ratio-dependent coefficient $K_{ACT}$ applied in a step 308 of the subroutine of FIG. 3.

Also supplied to the input port 401 is variation correcting value information for correcting variations in the detected actual air-fuel ratio due to variations between sensor bodies used. This information may be supplied individually for each of the first and second oxygen concentration sensor elements, if the sensor body 100 has two oxygen sensor elements as in the illustrated embodiment of the invention. Specifically, the information may be supplied by utilizing label correction resistances $48_1$ and $48_2$, as shown in FIG. 4.

The values of the label correction resistances $48_1$ and $48_2$ are set to values corresponding to variations in the characteristics of sensor bodies compared with a standard sensor body. The degree of variation in the characteristics of individual sensor body is indicated by a label indicative of its resistance value. The label correction resistances $48_1$ and $48_2$ are used together with the sensor body 100 used. That is, for instance, they may be provided within a connecting coupler, not shown, arranged in a wire harness, not shown, connecting the sensor body 100 to the ECU 4, hereinafter referred to. When the sensor body 100 is electrically connected to the ECU 4, respective one ends of the resistances $48_1$, $48_2$ are connected to a predetermined voltage source Vcc, as shown in FIG. 4, whereby the variation correcting value information corresponding to their resistance values is inputted through the other ends of the resistances.

The input port 401 of the ECU 4 is provided therein with an A/D (analog-to-digital) converter, which converts the above-mentioned input analog signals to digital signals.

The ECU 4 is supplied with respective output signals from a throttle valve opening ($\theta_{TH}$) sensor 10, and an intake pipe absolute pressure ($P_{BA}$) sensor 12 as engine parameter sensors, which have then their voltage levels shifted to a predetermined level by a level shifter circuit 402 and successively applied to the A/D converter 404 through a multiplexer 403. The A/D converter 404 of the input port 401 supplies the digitally-converted data to a central processing unit (hereinafter called "the CPU") 406 via a data bus 405.

An output signal from an engine speed (Ne) sensor 14 is applied to a waveform shaper circuit 407 to have its pulse waveform shaped, and the shaped signal is supplied to the CPU 406 as a top-dead center position (TDC) signal, as well as to a counter 408. The counter 408 counts the time interval between an immediately preceding pulse of the TDC signal and a present pulse of same, inputted thereto from the Ne sensor 14. The counted value Me is proportional to the reciprocal of the actual engine rotational speed Ne. The counter 408 supplies the counted value Me to the CPU 406 via the data bus 405.

Further connected to the CPU 406 via the data bus 405 are a read-only memory (hereinafter called "the ROM") 409, and a random access memory (hereinafter called "the RAM") 410, and driving circuits 412–414. The RAM 410 temporarily stores results of calculations executed within the CPU 406, while the ROM stores a control program to be executed within the CPU 406 for calculation of a fuel injection period $T_{OUT}$ of fuel injection valves 11, and other various programs, as well as various maps and tables.

The CPU 406 determines whether to energize or deenergize the heater 31 and whether to close or open the switches $44_1$ and $44_2$, and then supplies driving signals corresponding to the determinations to the heater 31 and the switching circuit 44 via the driving circuits 412 and 413.

The CPU 406 determines operating conditions of the engine such as a feedback control condition, based on the aforementioned various engine parameter signals including an output signal from the $O_2$ sensor 1, and calculates the fuel injection period of the fuel injection valves 11 in synchronism with TDC signal pulses in response to the determined engine operating conditions, based on a control program, not shown, by the use of the following equation (2):

$$T_{OUT}=Ti\times K_{O2}\times K_1+K_2 \quad (2)$$

where Ti represents a basic fuel injection period, which is calculated from a Ti map, not shown, stored in the ROM 409, in response e.g. to the absolute pressure $P_{BA}$ within the engine intake pipe, and the engine rotational speed Ne. $K_{O2}$ represents an air-fuel ratio correction coefficient, which is determined, in response to oxygen concentration in the actual exhaust gases, based on a control program, not shown, when the engine is in the feedback control region, while it is set to a predetermined value when the engine is in an open loop control region. $K_1$ and $K_2$ respectively represent other correction coefficients and correction variables obtained in response to various engine parameter signals, and are set to such desired values as to be able to optimize operating characteristics of the engine such as fuel consumption and accelerability.

The CPU 406 supplies the driving signals responsive to the results of the above calculation to the fuel injection valves 11 via the driving circuit 414. The air-fuel ratio is thus feedback-controlled to a desired ratio or stochiometric ratio during the feedback operating condition of the engine.

The oxygen concentration is detected by the $O_2$ sensor in the following manner.

First, when the first oxygen concentration detecting element is selected, as shown in FIG. 1, the exhaust gases are introduced into the first gas diffusion chamber $23_1$ through the first slit $24_1$ with operation of the engine. This causes a difference in oxygen concentration between the first gas diffusion chamber $23_1$ and the air reference chamber 26 into which air is introduced. Consequently, a voltage (sensor voltage) corresponding to the difference is developed between the electrodes $27_1$a and $27_1$b of the cell element $28_1$, which is added to the line 1 voltage $V_{CENT}$ and the same is applied to the inverting input terminal of the differential amplifier circuit $42_1$. As stated before, the reference voltage Vso supplied to the non-inverting input terminal of the differential amplifier circuit $42_1$ is set to the sum of a voltage developed across the cell element $28_1$ when the actual air-fuel ratio is equal to the stoichiometric air-fuel ratio, and the reference voltage $V_{REF}$ supplied to the operational amplifier circuit 41.

Therefore, when the air-fuel ratio is on the lean side, the voltage between the electrodes $27_1$a and $27_1$b of the cell element $28_1$ is lowered, while the line 1 voltage $V_{CENT}$ is maintained at $V_{REF}$, so that the sum of the voltage between the electrodes $27_1$a and $27_1$b and the $V_{CENT}$ becomes lower than the reference voltage Vso. Thus, the output level of the differential amplifier circuit $42_1$ becomes positive, and the positive level voltage is applied to the oxygen-pumping element $30_1$ via the switch $44_1$. By applying the positive level voltage, when the oxygen-pumping element $30_1$ is activated, oxygen present within the gas diffusion chamber $23_1$ is ionized, whereby the resulting ions move through the electrode $29_1$b, the second wall 22, and electrode $29_1$a to be emitted therefrom as oxygen gas or pumped out of the the $O_2$ sensor 1. Then, the pumping current Ip flows from the electrode $29_1$a to the electrode $29_1$b and flows through the current detecting resistance 46 via the line 1. At this time, the pumping current Ip flows from the line 1 to the output side of the operational amplifier circuit 41.

On the other hand, when the air-fuel ratio is on the rich side, the sum of the voltage between the electrodes $27_1$a and $27_1$b of the cell element $28_1$ and the line 1 voltage $V_{CENT}$ becomes higher than the reference voltage Vso, so that the output level of the differential amplifier circuit $42_1$ becomes negative. Consequently, reversely to the above described action, external oxygen is pumped into the gas diffusion chamber $23_1$ through the oxygen-pumping element $30_1$, and simultaneously the pumping current Ip flows from the electrode $29_1$b to the electrode $29_1$a and flows through the current detecting resistance 46, that is, the direction of flow of the pumping current Ip is reversed to the above case.

When the actual air-fuel ratio is equal to the stoichiometric air-fuel ratio, the sum of the voltage between the electrodes $27_1$a and $27_1$b of the cell element 28 and the line 1 voltage $V_{CENT}$ becomes equal to the reference voltage Vso, so that the pumping-in and -out of oxygen is not effected, whereby no pumping current flows (that is, the pumping current Ip is zero).

As described above, since the pumping-in and -out of oxygen and hence the pumping current Ip are controlled so as to maintain the oxygen concentration in the gas diffusion chamber $23_1$ at a constant level, the pumping current Ip assumes a value proportional to the oxygen concentration of the exhaust gases on both the lean and rich sides of the actual air-fuel ratio.

Signals for detecting the amount of the pumping current Ip flowing through the current detecting resistance 46, e.g. signals indicative of respective voltages $I_{PVW}$, $V_{CENT}$, $I_{PVN}$ at the opposite ends of the resistance 46 are supplied to the ECU 4.

Similarly to the first oxygen concentration sensor element, when the second oxygen concentration sensor element is used (that is, when the switch $44_2$ of the switching circuit 44 is closed, as reversely to the position shown in FIG. 2), the pumping-in and -out of oxygen is controlled so as to maintain the oxygen concentration in the second gas diffusion chamber $23_2$ at a constant value, that is, the voltage between the electrodes $27_2$a and $27_2$b of the cell element $28_2$ is feedback-controlled to be maintained at a constant value, and at the same time the signals indicative of the voltages $I_{PVW}$, $V_{CENT}$, $I_{PVN}$ for detecting the pumping current Ip flowing during the feedback control are supplied to the ECU 4 as outputs of the second oxygen concentration sensor element.

Figure 3A:
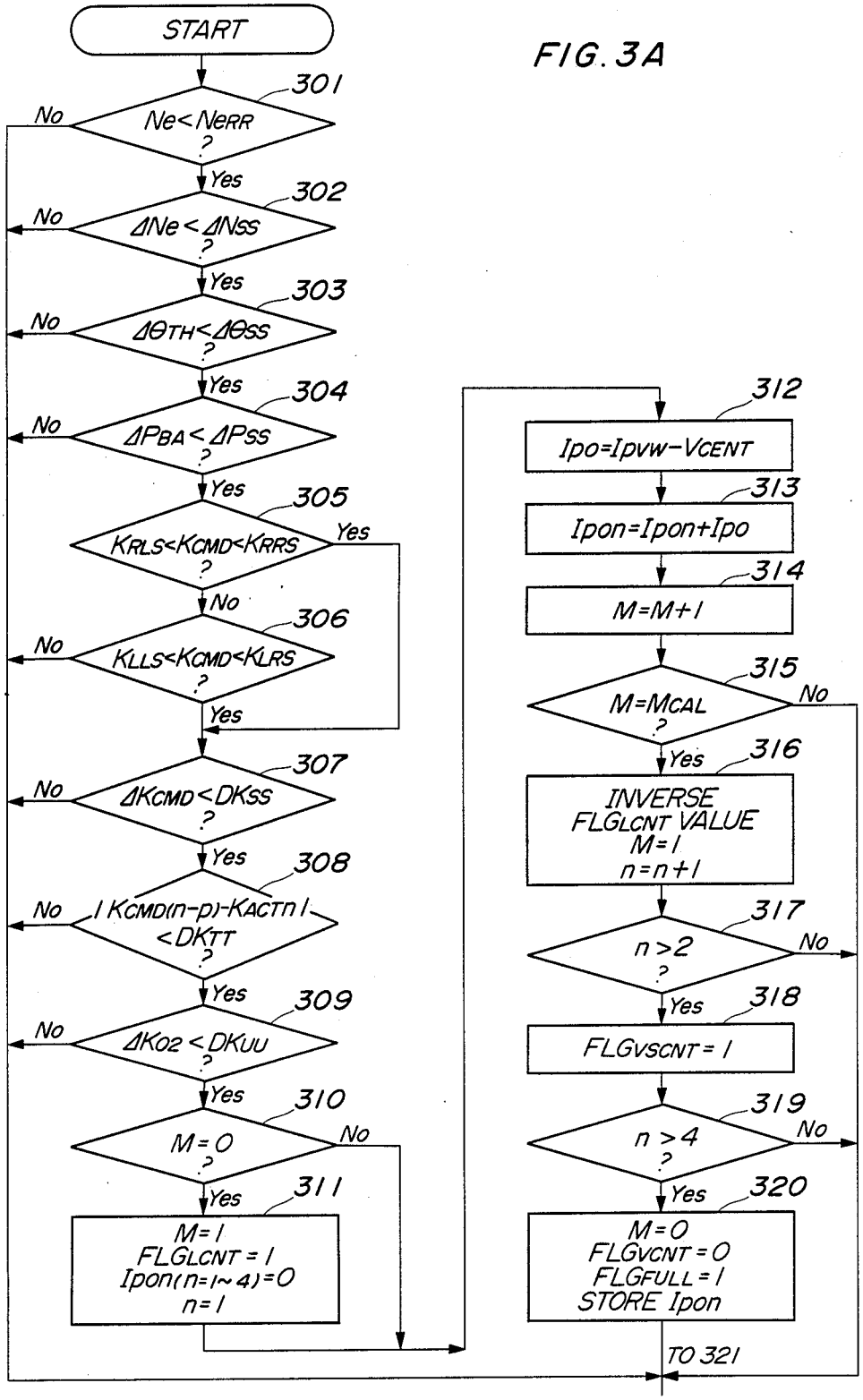
FIG. 3 is a flowchart of a subroutine for correcting the output value of the sensor in FIG. 1.
Figures 3, 3B:
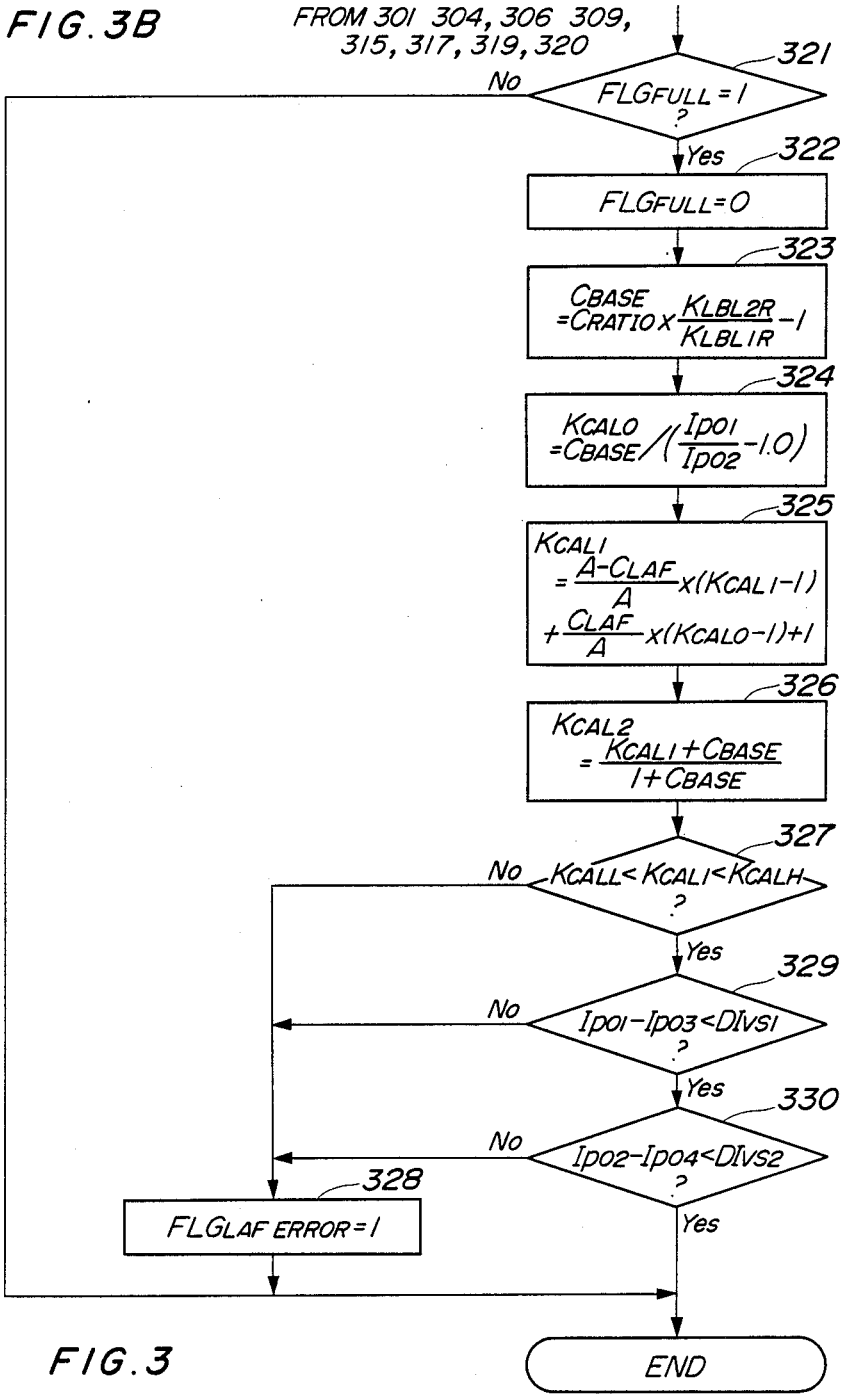

FIG. 3 shows a subroutine for correcting the output value of the $O_2$ sensor 1 for deterioration of same, according to the method of the invention, which is executed upon generation of each pulse of the TDC signal and in synchronism therewith.

At steps 301 to 309, it is first determined whether or not conditions under which the output value of the O2 sensor 1 is to be corrected for deterioration of same, are fulfilled depending upon engine operating conditions and the controlled air-fuel ratio.

Specifically, first, it is determined at a step 301 whether or not the rotational speed Ne of the engine is lower than a predetermined value $Ne_{RR}$, e.g., 5,000 rpm, defining the lower limit of a predetermined high rotational speed region. If $Ne \geqq Ne_{RR}$ is satisfied, that is, if the engine is in the predetermined high rotational speed region, it is determined that one of the output correcting conditions is not satisfied, and the program proceeds to a step 321, hereinafter referred to.

If the answer to the question of the step 301 is affirmative or Yes, that is, if the engine is not in the predetermined high rotational speed region, it is determined at steps 302 to 304 whether or not the engine is in stable operation, by determining whether or not respective rates of change in the engine rotational speed $\Delta Ne$, the throttle valve opening $\Delta\theta_{TH}$, and the intake pipe absolute pressure $\Delta P_{BA}$ are smaller than respective predetermined values, $\Delta N_{SS}$, e.g., 10 rpm; $\Delta\theta_{SS}$, e.g., 0.5 degrees; and $\Delta P_{SS}$, e.g., 5 mmHg. Each of the rates of change $\Delta Ne$, $\Delta\theta_{TH}$, and $\Delta P_{BA}$ is the difference in parameter value between the present loop and the immediately preceding loop, i.e., the difference between a parameter value obtained upon generation of an immediately preceding TDC signal pulse and a present one. If at least one of the answers to the questions of the steps 302 to 304 is negative or No, that is, if at least one of $\Delta Ne \geqq \Delta N_{SS}$, $\Delta\theta_{TH} \geqq \Delta\theta_{SS}$, and $\Delta P_{BA} \geqq \Delta P_{SS}$ is satisfied, it is considered that the engine is not in stable operation, which means that conditions for the output correction are not fulfilled, and the program proceeds to the step 321. On the other hand, if all the answers are affirmative or Yes, that is, if $\Delta Ne < \Delta N_{SS}$, $\Delta\theta_{TH} < \Delta\theta_{SS}$, and $\Delta P_{BA} < \Delta P_{SS}$ are all satisfied, it is determined that the engine is in stable operation, and the program proceeds to steps 305 et seq.

At steps 305 and 306, it is determined whether or not a desired air-fuel ratio coefficient (hereinafter called "the desired ratio coefficient") $K_{CMD}$ corresponding to a desired air-fuel ratio is within a predetermined range. Specifically, it is first determined at the step 305 whether or not $K_{RLS} < K_{CMD} < K_{RRS}$ is satisfied, wherein $K_{RLS}$ and $K_{RRS}$ are first and second predetermined values on the rich side, e,g., 1.1 and 1.3, respectively, both larger than 1.0, and it is then determined at the step 306 whether or not $K_{LLS} < K_{CMD} < K_{LRS}$ is satisfied, wherein $K_{LLS}$ and $K_{LRS}$ are first and second predetermined values on the lean side, e,g., 0.7 and 0.9, both smaller than 1.0.

The desired ratio coefficient $K_{CMD}$ is set in accordance with a subroutine, not shown, in response to engine operating conditions such that it is set to 1.0 when the desired air-fuel ratio is equal to the stoichiometric ratio, e.g., 14.7, and set to a value larger than 1.0 when the desired air-fuel ratio is richer than the stoichiometric ratio, and to a value smaller than 1.0 when the desired air-fuel ratio is leaner than the stoichiometric ratio.

If both the answers to the questions of the steps 305 and 306 are negative or No, that is, if $K_{RLS}<K_{CMD}<K_{RRS}$ and $K_{LLS}<K_{CMD}<K_{LRS}$ are not satisfied and the desired ratio coefficient $K_{CMD}$ is not within either of the predetermined ranges, it is judged that the actual air-fuel ratio is not stable, and the program proceeds to the step 321. On the other hand, if one of the answers is affirmative or Yes, that is, if the desired ratio coefficient $K_{CMD}$ is within one of the predetermined ranges on the rich and lean sides, the program proceeds to a step 307. Incidentally, a value of $K_{CMD}$ at and in the vicinity of 1.0, at which the desired air-fuel ratio is equal to the stoichiometric ratio, is not covered by either of the above predetermined ranges for prohibiting the output correction at and in the vicinity of 1.0, because the pumping current Ip then assumes a value of nearly zero, making it difficult to effect the output correction with accuracy.

At the step 307, it is determined whether or not a rate of change $\Delta K_{CMD}$ is smaller than a predetermined value $DK_{SS}$, e.g., 0.05. If the answer is negative or No, that is, if $\Delta K_{CMD} \geqq DK_{SS}$ is satisfied, it is judged that the desired air-fuel is largely varying, and the program proceeds to the step 321.

If the answer to the question of the step 307 is affirmative or Yes, that is, if $\Delta K_{CMD}<DK_{SS}$ is satisfied, it is determined at a step 308 whether or not the absolute value of the difference between a value $K_{CMD(n-p)}$ of the desired coefficient $K_{CMD}$ assumed in a loop before the present loop by a predetermined number P of loops and a value $K_{ACTn}$ of an actual ratio coefficient $K_{ACT}$, hereinbelow mentioned, assumed in the present loop, i.e., $|K_{CMD(n-p)}-K_{ACTn}|$ is smaller than a predetermined value $DK_{TT}$, e.g., 0.05. The actual ratio coefficient $K_{ACT}$ corresponds to the actual air-fuel ratio which has been detected by the $O_2$ sensor 1. As the value $K_{ACT}$, a value $K_{ACT1}$ for the first sensor element and a value $K_{ACT2}$ for the second sensor element are determined in response to a voltage value $V_{OUT}$ converted from the pumping current Ip in accordance with a table shown in FIG. 4. The value of $K_{ACT}$ is set such that it is set to 1.0 when the air-fuel ratio assumes the stoichiometric ratio, and set to a value larger than 1.0 when the air-fuel ratio is richer than the stoichiometric ratio, and a value smaller than 1.0 when the air-fuel ratio is leaner than same. In other words, the value of the actual ratio coefficient $K_{ACT}$ linearly varies at a nearly constant rate with change in the air-fuel ratio and hence the voltage-converted value $V_{OUT}$ on both the rich and lean sides.

If the answer to the question of the step 308 is negative or No, that is, if $|K_{CMD(n-p)}-K_{ACTn}| \geqq DK_{TT}$ is satisfied, it is considered that the condition for the output correction is not fulfilled, and the program proceeds to the step 321. Thus, when the difference between the desired air-fuel ratio and the actual air-fuel ratio is large, no output correction is carried out so that it is possible to avoid inaccurate output correction caused by change in the air-fuel ratio during output correction, such as at the restart of the hot engine, as hereinbefore mentioned, and hence improve the accuracy of output correction. Further, on such occasion, the feedback control is continued without being interrupted while the output correction is inhibited so that the actual air-fuel ratio is promptly brought to the desired ratio, thereby improving the responsiveness of the air-fuel ratio control.

Figure 5:
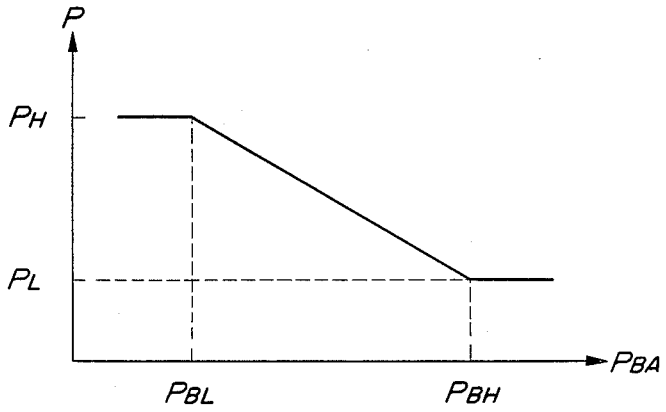
FIG. 5 is a graph showing a table of a predetermined number P of TDC signal pulses applied in the step 308 in FIG. 3.

Since as stated above the value of $K_{CMD}$ obtained in the loop before the present loop by the predetermined number P of loops is used in determining the difference between the desired air-fuel ratio and the actual air-fuel ratio at the step 308, time lag in the air-fuel ratio control system can be compensated for. FIG. 5 shows a table for setting a value of the predetermined number P. As shown in the figure, the value of the predetermined number P may be set depending upon the intake pipe absolute pressure $P_{BA}$. Specifically, it is set to a first predetermined value $P_H$, e.g., 20, when the value of $P_{BA}$ is equal to and lower than a first predetermined value $P_{BL}$ on the lower pressure side, and a second predetermined value $P_L$, e.g., 4, which is smaller than the first predetermined value $P_H$, when the value of $P_{BA}$ is equal to and higher than a second predetermined value $P_{BH}$ on the higher pressure side. When the value of $P_{BA}$ falls between the first and second predetermined values $P_{BL}$ and $P_{BH}$, the value of the predetermined number P is determined by an interpolation method. Since the present subroutine is executed upon generation of each pulse of the TDC signal and in synchronism therewith, the predetermined number P as the time lag can be determined from the engine rotational speed Ne and the intake pipe absolute pressure $P_{BA}$.

If the answer to the question of the step 308 is affirmative or Yes, that is, if $|K_{CMD(n-p)}-K_{ACTn}|<DK_{TT}$ is satisfied, it is determined at a step 309 whether or not a rate of change $\Delta K_{O2}$ in the air-fuel ratio correction coefficient $KO_2$ is smaller than a predetermined value $DK_{UU}$, e.g., 0.05. The air-fuel ratio correction coefficient $K_{O2}$, which is applied to the aforementioned equation (2) for actually correcting the air-fuel ratio, is determined based on the difference between the desired ratio coefficient $K_{CMD}$ and the actual ratio coefficient $K_{ACT}$ in accordance with a subroutine of FIG. 6, hereinafter described. If the answer to the question of the step 309 is negative or No, that is, if $\Delta K_{O2} \geqq DK_{UU}$ is satisfied, it is judged that the actual air-fuel ratio is not stable, and the program proceeds to the step 321, whereas if the answer is affirmative or Yes, that is, if $\Delta K_{O2}<DK_{UU}$ is satisfied, it is judged that all the conditions for the output correction are fulfilled according to the determination results so far obtained, and the program proceeds to steps 310 et seq.

At steps 310 to 320, addition of values of the pumping current Ip (hereinafter called merely "the addition") is executed for obtaining cumulated values Ipon used for carrying out the output correction.

Specifically, at a step 310, it is first determined whether or not a control variable M is equal to 0. The control variable M is set to 0 upon initialization of the ECU 4 and at a step 320, hereinafter described, immediately after the addition has been done. If the answer to the question of the step 310 is affirmative or Yes, that is, if no addition has yet been carried out after initialization of the ECU 4, the program proceeds to a step 311, wherein the control variable M is set to 1 for selecting the first oxygen concentration sensor element to operate, followed by setting a flag $FLG_{LCNT}$ to 1 to indicate the selection of the first sensor element. Further, all the values of the cumulated value Ipon (n=1–4) of pumping current Ip are reset to 0, and a processing number n representing this resetting is set to 1. On this occasion, the respective reference voltages Vso of the reference voltage sources $43_1$, $43_2$ for the differential amplifiers $42_1$ and $4_{22}$ have been set to 2.95 V.

At a step 312, neutral or zero potential correction is effected. That is, the voltage $V_{CENT}$ is subtracted from the aforementioned output voltage $I_{PVW}$ of the operational amplifier circuit 41 to obtain a voltage value Ipo (hereinafter called "the pumping current value") corresponding to the pumping current Ip. Then, the obtained pumping current value Ipo is added to the cumulated value Ipon, which has been obtained so far before the present loop, to obtain a new cumulated value Ipon, at a step 313, and the control variable M is increased by 1, at a step 314. Then, it is determined at a step 315 whether or not the control variable M is equal to a predetermined value $M_{CAL}$, e.g., 20. If the answer is negative or No, the program proceeds to the step 321, wherein it is determined whether or not a flag $FLG_{FULL}$ has been set to 1. If the answer is negative or No, the program terminates. The flag $FLG_{FULL}$, which was set to 0 at the time of initialization of the ECU 4, is set to 1 at the step 320 immediately after all the additions of the cumulated values Ipo1–Ipo4 have been made. Consequently, the addition at the steps 312 to 314 is repeatedly carried out until the answer to the question of the step 315 becomes affirmative, i.e., until $M=M_{CAL}$ is satisfied, whereby a cumulated value Ipol corresponding to a value 1 of the processing number n, i.e., n=1, is obtained as the sum of values of the pumping current value Ipo added together a number $M_{CAL}$ of times.

If the answer to the question of the step 315 is affirmative or Yes, that is, if $M=M_{CAL}$ becomes satisfied, the program proceeds to a step 316, wherein the second oxygen concentration sensor element is selected to operate in place of the first oxygen concentration sensor element, and the flag $FLG_{LCNT}$ is inverted, i.e., it is set to 0 to indicate the selection of the second sensor element, the control variable M is reset to 1, and further the processing number n is increased by 1 into n=2.

Then, it is determined at a step 317 whether or not the processing number n is larger than 2. If the answer is negative or No, the program proceeds to the step 321. On this occasion, the processing number n is equal to 2 so that the answer to the question of the step 317 becomes negative or No, and further the answer to the question of the step 321 becomes negative or No. As a result, the addition at the steps 312 to 314 is further repeatedly carried out to obtain a second cumulated value Ipo2 corresponding to n=2 as the sum of values of the pumping current value Ipo added together the number $M_{CAL}$ of times, similarly to the above-mentioned cumulated value Ipol.

If the answer to the question of the step 315 is again becomes affirmative or Yes, i.e., $M=M_{CAL}$ is satisfied, the step 316 is again executed and the first oxygen concentration sensor element is selected in place of the second oxygen concentration sensor element, followed by inversion of the flag $FLG_{LNCT}$ into 1, the control variable M is set to 1, and the processing number n is increased by 1 into n=3. On this occasion, the answer to the question of the step 317 is affirmative or Yes, that is, n>2 is satisfied, and then the program proceeds to a step 318.

At the step 318, the respective reference voltages Vso of the reference voltage sources $43_1$ and $43_2$, which have been set to 2.95 V, are changed to 3.05 V, followed by setting a value of a flag $FLG_{VSCNT}$, which has been set to 0 upon initialization of the ECU 4, to 1 to indicate the change of Vso. Then, it is determined at a step 319 whether or not the processing number n is larger than 4. If the answer is negative or No, the program proceeds to the step 321. As can be understood from the above description, a third cumulated value Ipo3 corresponding to n=3 and a fourth cumulated value Ipo4 corresponding to n=4 are, respectively, obtained as the sums of values of the pumping current value Ipo each added together the number $M_{CAL}$ of times.

Immediately after all the cumulative values Ipo1–Ipo4 have been obtained, the following execution of the step 316 renders the processing number n equal to 5, whereby the answer to the question of the step 319 becomes affirmative or Yes. That is, all the cumulated values Ipo1–Ipo4 of the pumping current value Ipo have been determined. Then, the program proceeds to a step 320, wherein the control variable M as well as the flag $FLG_{VSCMT}$ are both set to 0, and the flag $FLG_{FULL}$ is set to 1. The cumulated values Ipol–Ipo4 obtained are stored into the RAM 410, and the program proceeds to the step 321. In the above described manner, the cumulated values Ipol–Ipo4 of the pumping current Ipo are calculated and stored in relation to respective four combinations of the selected oxygen concentration sensor elements and the set values of the reference voltages Vso of the reference voltage sources $43_1$, $43_2$ of the differential amplifier $42_1$, $42_2$, as shown in the following table:

| CUMULATED VALUE Ipon | SENSOR ELEMENT | REFERENCE VOLTAGE Vso |
|---|---|---|
| Ipo1 | First Sensor Element | 2.95 V |
| Ipo2 | Second Sensor Element | 2.95 V |
| Ipo3 | First Sensor Element | 3.05 V |
| Ipo4 | Second Sensor Element | 3.05 V |

In the step 321, it is determined whether or not the flag $FLG_{FULL}$ has been set to 1. On this occasion, the answer is affirmative or Yes, because of the execution of the step 320. Then the flag $FLG_{FULL}$ is reset to 0 at a step 322, and the program proceeds to steps 323 et seq. for carrying out the output correction.

First, at the step 323, a basic value $C_{BASE}$ for carrying out the output correction is calculated by the use of label-resistance correction coefficients $K_{LBL1R}$ and $K_{LBL2R}$, each of which has been determined from label-resistance value information from the label resistances $48_1$, $48_2$ on the side of the first and second oxygen concentration sensor elements, by the use of the following equation:

$$C_{BASE}=C_{RATIO}\times K_{LBL2R}/K_{LBL1R}-1.0 \quad (3)$$

where $C_{RATIO}$ represents a constant value, which has been set beforehand depending upon the difference in diffusion resistance between the first and second oxygen concentration sensor elements.

Then, a provisional value $K_{CAL0}$ of a first output correction coefficient $K_{CAL1}$ for correcting the output value of the first oxygen concentration sensor element is calculated at a step 324 by the use of the following equation:

$$K_{CAL0}=C_{BASE}/[(Ipo1/Ipo2)-1.0] \quad (4)$$

where the provisional value $K_{CAL0}$, which represents a deviation of the output of the first sensor element from that of the second sensor element at the time of the present output correction, and is set to 0 upon initialization of the ECU 4 and stored in a backup RAM together with the first output correction coefficient $K_{CAL1}$ and a second output correction coefficient $K_{CAL2}$, hereinafter described.

Then, the first output correction coefficient $K_{CAL1}$ is calculated by the use of the following equation:

$$K_{CAL1}=(A-C_{LAF})/A\times(K_{CAL1'}-1)+C_{LAF}(-K_{CAL0}-1)/A+1 \quad (5)$$

where A represents a constant value, $C_{LAF}$ an averaging constant experimentally obtained, which is set to an appropriate value between 1 and A, and $K_{CAL1'}$ an average value of values of $K_{CAL1}$ obtained through past operation of the engine and stored.

Since the ratio of $K_{CAL0}$ to $K_{CAL1'}$ varies with the value of the averaging constant $C_{LAF}$, the output correction can optimally be carried out by setting the averaging constant $C_{LAF}$ to such a value that best suits the type of an $O_2$ sensor, an air-fuel ratio feedback control system, etc. to be applied.

Then, the second output correction coefficient $K_{CAL2}$ for correcting the output value of the second oxygen concentration sensor element is calculated at a step 326, by the use of the following equation:

$$K_{CAL2}=(K_{CAL1}+C_{BASE})/(1+C_{BASE}) \quad (6)$$

Then, it is determined at a step 327 whether or not the first output correction coefficient $K_{CAL1}$ is larger than a lower-limit value $K_{CALL}$, e.g., 0.4, and smaller than an upper-limit value $K_{CALH}$, e.g., 1.6. The first output correction coefficient $K_{CAL1}$ should assume a normal value of 1.0 when there is no deterioration in the $O_2$ sensor 1. Therefore, if the answer to the question of the step 327 is negative or No, that is, if $K_{CAL1}\leqq K_{CALL}$ or $K_{CAL1}\geqq K_{CALH}$ is satisfied, it is judged that there is large deterioration in the $O_2$ sensor 1, and the program proceeds to a step 328, wherein the flag $FLG_{LAFERROR}$ is set to 1 to indicate the above deteriorated state of the $O_2$ sensor 1, thereby giving warning to the driver by lightening an alarm light, for example.

If the answer to the question of the step 327 is affirmative or Yes, that is, if $K_{CALL}<K_{CAL1}<K_{CALH}$ is satisfied, it is determined at a step 329 whether or not the difference between the first cumulated value Ipo1 and the third cumulated value Ipo3 of the pumping current value Ipo is smaller than a first predetermined value $DI_{VS1}$, and at a step 330 whether or not the difference between the second cumulated value Ipo2 and the fourth cumulated value Ipo4 of the pumping current value Ipo is smaller than a second predetermined value $DI_{VS2}$. These determinations are for judging the degree of deterioration in the same oxygen concentration sensor element of the $O_2$ sensor 1 by determining the degree of deviation in the pumping current value Ipo obtained by the changeover of the reference voltage Vso value of the differential amplifier $42_1$, $42_2$, or voltage applied to the sensor, from 2.95 V to 3.05 V or vice versa. As is well known, a sensor of this kind generally has such a characteristic that the pumping current value Ipo hardly varies even with variation in the voltage applied to the sensor within a predetermined range. Therefore, it is possible to judge the degree of deterioration in the $O_2$ sensor 1 by executing the steps 329 and 330. Therefore, if either one of the answers to the questions of the steps 329 and 330 is negative or No, that is, if Ipo1–Ipo3 $\geqq DI_{VS1}$ or $I_{P02}-I_{P04}\geqq DI_{VS2}$ is satisfied, it is judged that there is large deterioration in the $O_2$ sensor 1 and the aforementioned step 328 is executed, followed by terminating the program.

Figure 6:
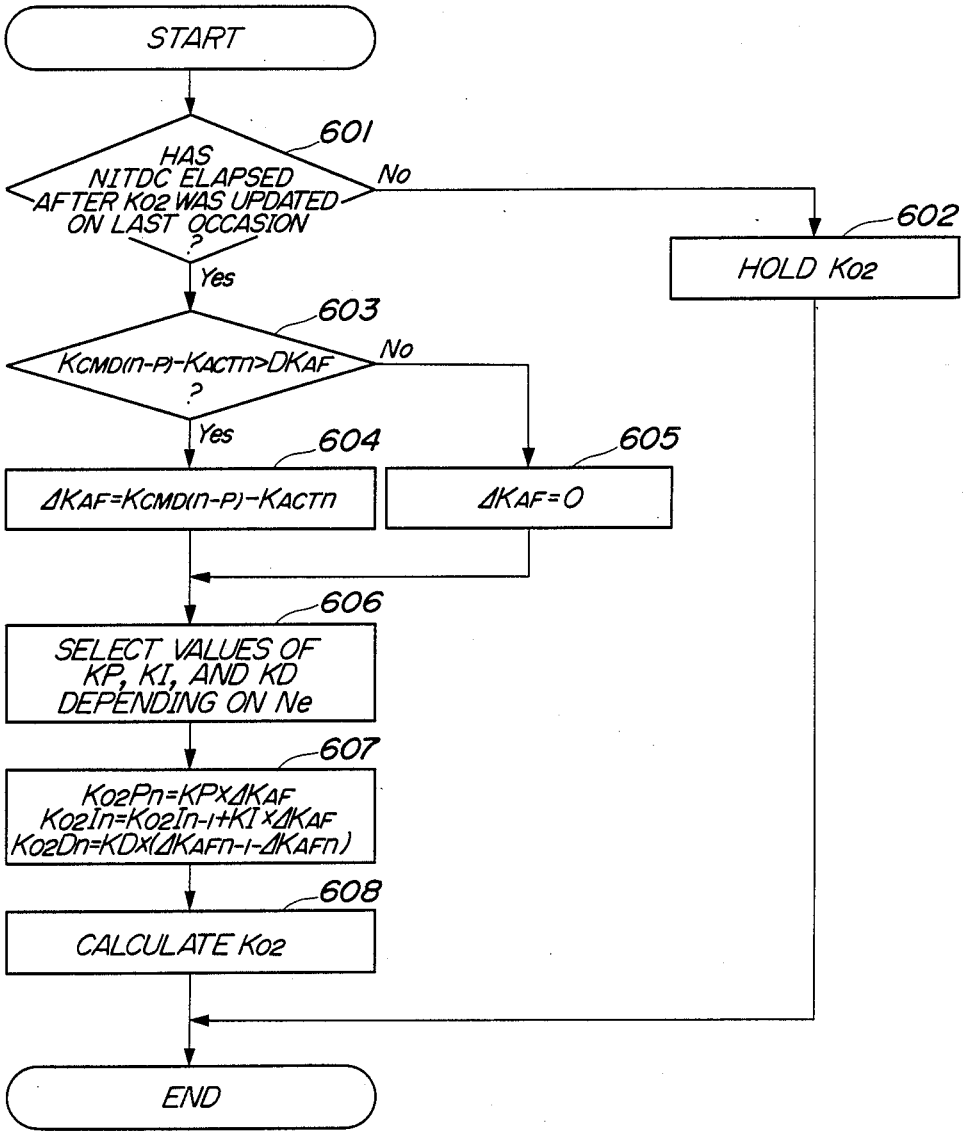
FIG. 6 is a flowchart of a subroutine for calculating an air-fuel ratio correction coefficient $K_{O2}$.

FIG. 6 shows a subroutine for calculating a value of the air-fuel ratio correction coefficient $K_{O2}$ applied to the step 309 in the subroutine of FIG. 3, which is executed upon generation of each pulse of the TDC signal and in synchronism therewith.

In the subroutine, it is first determined at a step 601 whether or not a pulse of the TDC signal has been generated a predetermined number NITDC of times, e.g , 4 times, after the air-fuel ratio correction coefficient $K_{O2}$ was updated on the last occasion. If the answer is negative or No, a value of $K_{O2}$ is held at a value obtained immediately before open-loop control on the last occasion, at a step 602, followed by terminating the program. Thus, the value of the $K_{O2}$ is updated whenever the predetermined number NITDC of TDC signal pulses have been generated.

If the answer to the question of the step 601 is affirmative or Yes, it is determined at a step 603 whether or not the difference between the value $K_{CMD(n-p)}$ of the desired ratio coefficient $K_{CMD}$, which has been obtained in a loop preceding the present loop by the predetermined number P of loops, and the value $K_{ACTn}$ of the actual coefficient $K_{ACT}$ in the present loop, i.e., $K_{CMD(n-p)}-K_{ACTn}$, is larger than a predetermined value $DK_{AF}$, similarly to the step 308 of FIG. 3. If the answer is affirmative or Yes, that is, if $K_{CMD(n-p)}-K_{ACTn}>DKAF$ is satisfied, the value of the difference is applied as a difference $\Delta K_{AF}$ between the desired coefficient and the actual coefficient $K_{ACT}$, whereas if the answer is negative or No, that is, if $K_{CMD(n-p)}-K_{ACTn}\geqq DK_{AF}$ is satisfied, it is considered that the difference between the desired air-fuel ratio and the actual air-fuel ratio is small so that the difference $\Delta K_{AF}$ is set to 0 at a step 605 for stabilizing the feedback control, and the program proceeds to a step 606.

At the step 606, respective values of a coefficient KP for proportional-control term, a coefficient KI for integral-control term, and a coefficient KD for differential-control term are selected from tables, not shown, stored in the RAM, depending on the engine rotational speed Ne. Then, the selected values of the coefficients KP, KI, and KD as well as the difference $\Delta K_{AF}$ calculated at the step 604 or 605 are applied to the following equations for calculating values of the proportional-control term $K_{O2Pn}$, integral-control term $K_{O2In}$, and differential-control term $K_{O2Dn}$, at a step 607.

$$K_{O2Pn}=KP\times\Delta K_{AF} \quad (7)$$

$$K_{O2In}=K_{O2In-1}+KI\times\Delta K_{AF} \quad (8)$$

$$K_{O2Dn}=KD\times(\Delta K_{AFn-1}-\Delta K_{AFn}) \quad (9)$$

Then, the value of the air-fuel ratio correction coefficient $K_{O2}$ is calculated by summing up the calculated values of the proportional-control term $K_{O2Pn}$, the integral-control term $K_{O2In}$, and the differential-control ter $K_{O2Dn}$, followed by terminating the program.

Figure 8:
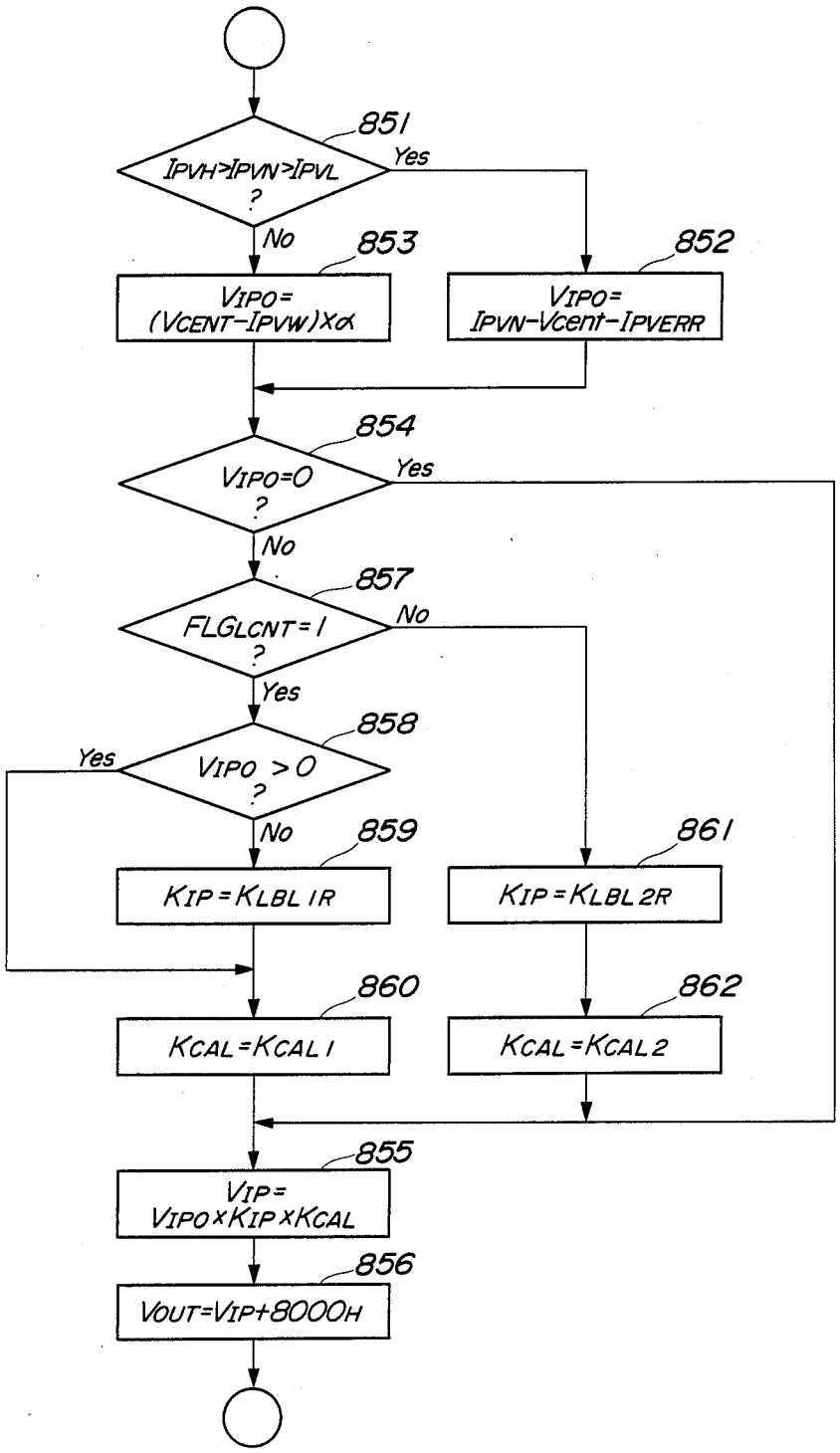
FIG. 8 is a flowchart of a subroutine for calculating a voltage-converted value $V_{OUT}$ of pumping current Ip by the use of first and second output correction coefficients $K_{CAL1}$ and $K_{CAL2}$ determined at steps 325 and 326 in the subroutine of FIG. 3.

FIG. 8 shows a subroutine for calculating the voltage-converted value $V_{OUT}$ of the pumping current Ip by the use of the first and second output correction coefficients $K_{CAL1}$, $K_{CAL2}$ which have been calculated in the steps 325 and 326 in the subroutine of FIG. 3. This subroutine includes correction of the sensor output. This program is executed in the CPU 406 upon generation of each TDC signal pulse and in synchronism therewith.

At a step 851, it is determined whether or not the output voltage $I_{PVN}$ of the differential amplifier curcuit 47 is within a predetermined small value range with a middle value about which the voltage $I_{PVN}$ varies. That is, it is determined whether or not the $I_{PVN}$ is larger than a first predetermined value $I_{PVL}$ (e.g. 2.3 volts) and at the same time smaller than a second predetermined value $I_{PVH}$ (e.g. 2.6 volts). Depending upon the answer to the question of the step 851 it is determined whether to determine a voltage $V_{IPO}$ corresponding to the pumping current Ip either by using the voltage $I_{PVW}$ which is direct output of the operational amplifier cirucit 41, or by using the voltage $I_{PVN}$ which is obtained by amplifier the $I_{PVW}$ by the differential amplifier circuit 47.

If the answer to the question of the step 851 is Yes, that is, if the voltage $I_{PVN}$ fulfills the condition $I_{PVH} > I_{PVN} > I_{PVL}$ (which means that the pumping current Ip assumes a small value equal to 0 or in the vicinity of 0, and that the air-fuel ratio is within a narrow range about the stoichiometric air-fuel ratio (e.g., 14.7)), the value $I_{VPO}$ is calculated by the following equation (step 852):

$$V_{IPO} = I_{PVN} - V_{cent} - I_{PVERR} \quad (10)$$

where $V_{cent}$ represents a reference voltage for the voltage $V_{CENT}$ at the one end of the current detecting resistance 46 remote from the output of the operational amplifier circuit 41, while $I_{PVERR}$ represents a correction value for compensating for circuit errors such as the offest of the operational amplifier circuit 41.

The calculation at the step 852 is based on the following ground:

By using the voltage $I_{PVN}$ which is obtained by amplifying the voltage $I_{PVW}$ by the operational amplifier circuit 47 when the voltage $I_{PVN}$ assumes a value within the small value range of the step 852, it is possible to enhance the accuracy of calculation of the pumping current Ip. If the air-fuel ratio is changed to the lean side or to the rich side from the above small value range where the air-fuel ratio is equal to or close to the stoichiometric air-fuel ratio (14.7), such change exerts a great influence upon the purification degree i.e. conversion efficiency of the three-way catalyst. Therefore, more accuracy is required in detecting the air-fuel ratio than when the air-fuel ratio is changed within a range remote from the stoichiometric air-fuel ratio. In order to improve the detection accuracy in an air-fuel ratio range in the vicinity of the stoichiometric air-fuel ratio, the direct output voltage $I_{PVW}$ is not directly used but the amplified voltage $I_{PVN}$ applied to calculation of the voltage value $V_{IPO}$ which is obtained by amplifying $I_{PVW}$ by a predetermined number of times $\alpha$.

In the equation (10), the subtraction of the reference voltage $V_{cent}$ is effected for correcting the reference potential or zero potential.

As stated before, the potential of the pumping current detecting system including the current detecting resistance 46 and the operational amplifier circuit 41, is raised up by the reference voltage $V_{REF}$ to always maintain the voltages at the opposite ends of the resistance 46 at a positive level even if the direction of flow of the pumping current Ip is changed. Therefore, the voltage at the end of the resistance 46 close to the output of the operational amplifier circuit 41 varies about the reference voltage $V_{REF}$ from the reference voltage source 45, in response to the direction of flow of the pumping current Ip and the amount of the same current. Thus, the amount of the pumping current Ip can be determined from the difference between the reference voltage $V_{REF}$ and a voltage varying in response to the flow of the pumping current Ip. Therefore, at the step 852 the reference voltage $V_{cent}$ is subtracted.

The reference voltage $V_{cent}$ corresponds to the line 1 voltage $V_{cent}$. If there is no circuit error in the operational amplifier circuit 41, etc., and the pumping current Ip is zero (that is, the air-fuel ratio is equal to the stoichiometric air-fuel ratio), the value $V_{cent}$ should be set to a valve equal to the reference voltage $V_{REF}$.

Therefore, by obtaining $(I_{PVN} - V_{cent})$, even there is an error (e.g. setting error) in the voltage from the reference voltage source 45, or even if the voltage from the source 45 varies, the value $(I_{PVN} - V_{cent})$ is always zero when the actual pumping current Ip is zero. This correction enables detecting the pumping current accurately. Thus, the air-fuel ratio detection accuracy is improved especially when the air-fuel ratio is in the vicinity of the stoichiometric air-fuel ratio (14.7), in addition to the aforementioned advantage of noise proof.

Referring again to the step 852, the correction value $I_{PVERR}$ is subtracted from $(I_{PVN} - V_{cent})$, whereby the detection accuracy can be further enhanced.

Although, in the above explanation, it has been assumed that there is no circuit error such as the offset in the operational amplifier circuit 41, actually there can be such an error in the circuit 41.

The offset voltage of an operational amplifier used as an amplifier is different between individual operational amplifiers and also varies due to aging change.

If there exists an offset voltage in the operational amplifier, then even when the air-fuel ratio actually remains unchanged, the detected pumping current Ip can show different values. That is, such error is liable to appear as noise in the pumping current Ip, which prevents accurate detection of the air-fuel ratio. Especially, in the vicinity of the stoichiometric air-fuel ratio, where the pumping current Ip assumes a small value near 0, the difference between the reference voltage $V_{cent}$ and the output voltage $I_{PVN}$ is small, so that the above described circuit error can effect a great influence upon the detection result.

In order to correct the circuit error, the subtraction of the correction value $I_{PVERR}$ is executed at the step 852. The correction value $I_{PVERR}$ corresponds to the difference between voltages appearing at the output and input of the differential amplifier 47 when no pumping current Ip is applied to the input of the amplifier 47. The value $I_{PVEPR}$ is previously determined and stored in the RAM 410, before detection of the air-fuel ratio, during a state where no pumping current is supplied to the current detecting resistance 46.

At the step 852, the correction value $I_{PVERR}$ is read from the RAM 410 and is subtracted from $(I_{PVN} - V_{cent})$, to thereby remove the circuit error contained in the present value $(I_{PVN} - V_{cent})$, whereby the voltage value $V_{IPO}$ accurately corresponds to the actual pumping current Ip.

If the answer to the question of the step 851 is No, that is, if $I_{PVN} \geqq I_{PVH}$ or $I_{PVN} \leqq I_{PVL}$ is fulfilled, which means the value of $I_{PVN}$ is out of the predetermined range, it is judged that the pumping current Ip has neither a value of 0 nor a small value in the vicinity of 0, that is, the air-fuel ratio is not in the vicinity of the stoichiometric air-fuel ratio (14.7). The program then proceeds to a step 853, in which the value $V_{IPO}$ is calculated by the following equation:

$$V_{IPO}=(V_{CENT}-I_{PVW})\times\alpha \quad (11)$$

where $\alpha$ is a predetermined value. That, is when the air-fuel ratio is not in the vicinity of the stoichiometric air-fuel ratio, the voltage $I_{PVW}$ is directly used as the terminal voltage of the current detecting resistance 46 close to the output of the operational amplifier circuit 41, and the voltage $V_{IPO}$ is obtained by calculating the difference between the line 1 voltage $V_{CENT}$ as the other terminal voltage of the resistance 46 and $I_{PVW}$, that is, $(V_{CENT}-I_{PVW})$. Therefore, in order to raise up the resulting value of $V_{IPO}$ to the same level as that of the resulting value obtained at the step 852, the difference $(V_{CENT}-I_{PVW})$ is multiplied by the predetermined value $\alpha$.

Also in the calculation at the step 853, the voltage $V_{IPO}$ value is obtained by using the pulled-up voltage $V_{CENT}$ in the line 1 and on the basis of the difference $(V_{CENT}-I_{PVW})$, so that potential correction is effected similarly to the step 852, whereby the voltage $V_{IPO}$ corresponding to the pumping current Ip is accurately detected irrespective of the influence of noise and an error in the reference voltage $V_{REF}$.

At a step 854, it is determined whether or not the $V_{IPO}$ value obtained at the step 852 or 853 is equal to 0, in order to judge whether or not the present air-fuel ratio is equal to the stoichiometric ratio. If the answer is Yes, that is, if Ip is equal to zero, the program jumps to a step 855 to execute the step 855 and a step 856, followed by termination of the program.

At the step 855, the $V_{IPO}$ value obtained at the step 852 or 853 is corrected to a $V_{IP}$ value by being multiplied by a label resistance coefficient $K_{IP}$. Then at the step 856, the value $V_{IP}$ obtained at the step 855 is increased by a predetermined number, e.g. 8000 in hexadecimal notation, to obtain a value $V_{OUT}$ as the output voltage.

At the step 854, if it is determined that the value $V_{IPO}$ is zero, the value $V_{IP}$ obtained at the step 855 is also zero, and therefore, the resulting $V_{OUT}$ value at the step 856 is 8000 in hexadecimal notation. The predetermined number is a reference or middle value of the $V_{OUT}$ value. When the air-fuel ratio is changed from the stoichiometric ratio to the lean side or to the rich side, the $V_{OUT}$ value is calculated by addition or subtraction of the present value of $V_{IP}$ to or from the middle value, in accordance with the $V_{IP}$ value (the $V_{IPO}$ value assumes a positive value when the air-fuel ratio is on the lean side with repsect to the stoichiometric ratio, and a negative value when the latter is on the rich side, and the $V_{IP}$ value also assumes a positive value or a negative value correspondingly).

As stated above, the voltage value $V_{IP}$ obtained at the step 855 is not made as the final value, but it is increased by the predetermined number at the step 856. This is for preventing the $V_{OUT}$ value from assuming a value of 0 even when the air-fuel ratio is equal to the stoichiometric ratio where the pumping current Ip is 0, to thereby enable avoiding an inconvenience encountered when the $K_{O2}$ value is determined on the basis of the $V_{OUT}$ value, e.g. when the $K_{O2}$ value is obtained by division.

If the answer to the question of the step 854 is No, it is determined at a step 857 whether or not a flag $FLG_{LCNT}$ has been set to a value of 1. The setting of the flag $FLG_{LCNT}$ value can be made dependent upon the selection of the switch $44_1$ or $44_2$. If the answer at the step 857 is Yes, it is determined that the first oxygen concentration sensor element in FIG. 1 is not being used, and then the program proceeds to step 858.

The flag $FLG_{LCNT}$ indicates whether the first oxygen concentration sensor element or the second oxygen concentration sensor element is being used. That is, when the first oxygen concentration sensor element is used the value N is set to 1, while it is set to 2 when the second oxygen concentration sensor element is being used.

At the step 858, it is determined whether or not the present $V_{IPO}$ value is larger than zero (i.e. positive or negative). That is, it is determined whether the air-fuel ratio is on the lean side or on the rich side with respect to the stoichiometric ratio.

If the answer to the question of the step 858 is Yes, that is, if the $V_{IPO}$ value is positive, it is determined that the air-fuel ratio is on the lean side, and then the program proceeds to a step 860. On the other hand, if the answer is No, that is, if the $V_{IPO}$ value is negative, it is determined that the air-fuel ratio is on the rich side, and then the program proceeds to a step 859, where the $K_{IP}$ value is set to the predetermined value $K_{LBL1R}$, followed by execution of the step 860.

The predetermined value $K_{LBL1R}$ at the step 859 is a correction coefficient for correcting variations in output characteristic between $O_2$ sensors when the air-fuel ratio is not the stoichiometric air-fuel ratio in such a manner that the $V_{IPO}$ value is corrected toward a richer value when the pumping current Ip is below zero during use of the first oxygen concentration sensor element.

The correction coefficient $K_{LBL1R}$ is obtained by a subroutine, not shown, wherein it is determined based on the value of the label correction resistance $48_1$ for the first oxygen concentration sensor element, as mentioned before.

At the step 860, the output correction coefficient $K_{CAL}$ is set to the value of the first output correction coefficient $K_{CAL1}$ for the first oxygen concentration sensor element, which has been calculated at the step 325 in the aforedescribed subroutine of FIG. 3, and then the program proceeds to the steps 855 and 856 to execute the same steps, followed by terminating the program.

Figure 7:
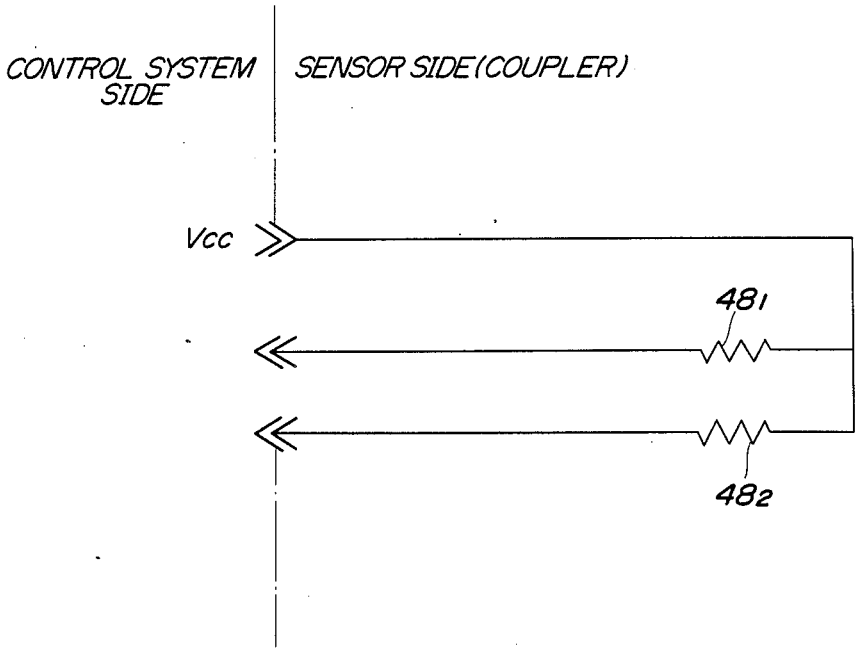
FIG. 7 is a diagram showing a wiring connection of label resistances.

If the answer to the question of the step 857 is negative or No, that is, if the value of the flag $FLG_{LCNT}$ is not equal to 1, it is determined that the second oxygen concentration sensor element is being selected to operate, the program proceeds to a step 861, wherein $K_{IP}$ is set at the value $K_{LBL2R}$ for the second oxygen concentration sensor element because, on this occasion, the resistance $48_2$ for the second oxygen concentration sensor element shown in FIG. 7 is used, the output correction coefficient $K_{CAL}$ is set to the value of the second output correction coefficient $K_{CAL2}$, which has been calculated at the step 326 in the subroutine of FIG. 3, at a step 862, and the program proceeds to the steps 855 and 856 to execute the same steps, followed by terminating the program.

As described above, according to the present invention, the output correction for deterioration in the exhaust gas-ingredient concentration sensor is carried out only when at least the difference between the desired air-fuel ratio and the actual air-fuel ratio is so small that the output correction of the sensor can be effected with accuracy. Further, even when the above difference is large, the feedback control is continued without executing the output correction, thereby improving the responsiveness of the air-fuel ratio control and hence the emission characteristics and reducing the fuel consumption of the engine.

What is claimed is:

1. In an output correction method for an exhaust gas ingredient-concentration sensor adapted for use in an internal combustion engine, said sensor having first and second sensor elements having output characteristics different from each other, said first and second sensor elements each producing an output proportional to the concentration of an ingredient in exhaust gases emitted from said engine, wherein said sensor controls the air-fuel ratio of a mixture supplied to said engine to a desired air-fuel ratio by the use of an output from at least one of said first and second sensor elements, the improvement comprising the steps of:

(1) determining whether or not a difference between said desired air-fuel ratio and an actual air-fuel ratio represented by said output of at least one of said first and second sensor elements is smaller than a predetermined value, and (2) correcting an output value of one of said first and second sensor elements based on an output value of the other of said first and second sensor elements when it is determined that said difference is smaller than said predetermined value.

2. A method as claimed in claim 1, wherein said step (1) comprises determining a first coefficient corresponding to said actual air-fuel ratio in the present loop from said output of said at least one of said first and second sensor elements, determining a second coefficient corresponding to said desired air-fuel ratio in a loop before the present loop by a predetermined number of loops, and determining whether or not a difference between the value of said first coefficient and the value of said second coefficient thus determined is smaller than a predetermined value.

3. A method as claimed in claim 2, wherein when said engine is operating in a predetermined feedback control region, said actual air-fuel ratio is controlled to said desired air-fuel ratio under feedback control based on said output of said sensor, and correction of said output value of said one of said first and second sensor elements being prohibited for continuing said feedback control when said difference between said desired air-fuel ratio and said actual air-fuel ratio is larger than said predetermined value.

4. A method as claimed in claim 1, wherein said output value of said one of said first and second sensor elements is corrected when said engine is in a predetermined stable operating condition.

5. A method as claimed in claim 4, wherein said predetermined stable operating condition is a condition where the rotational speed of said engine is lower than a predetermined value.

6. A method as claimed in claim 4, wherein said predetermined stable operating condition is a condition where a rate of change in the rotational speed of said engine is lower than a predetermined value.

7. A method as claimed in claim 4, wherein said predetermined stable operating condition is a condition where a rate of change in the opening of a throttle valve of said engine is lower than a predetermined value.

8. A method as claimed in claim 4, wherein said predetermined stable operating condition is a condition where a rate of change in absolute pressure within an intake pipe of said engine is lower than a predetermined value.

9. A method as claimed in claim 4, wherein said predetermined stable operating condition is a condition where a coefficient corresponding to said desired air-fuel ratio obtained in the present loop falls within a predetermined range about a stoichiometric ratio.

10. A method as claimed in claim 4, wherein said predetermined stable operating condition is a condition where a rate of change in said desired air-fuel ratio is lower than a predetermined value.

11. A method as claimed in claim 4, wherein said predetermined stable operating condition is a condition where a rate of change in a coefficient for correcting said actual air-fuel ratio is lower than a predetermined value.

* * * * *